United States Patent [19]

Brannan

[11] 3,934,772

[45] Jan. 27, 1976

[54] DEVICE FOR LIFTING, CARRYING AND INVERTING WATER COOLER BOTTLES

[75] Inventor: Jerome A. Brannan, St. Cloud, Minn.

[73] Assignee: Dansen Company, Inc., Waite Park, Minn.

[22] Filed: Aug. 30, 1974

[21] Appl. No.: 502,176

[52] U.S. Cl. ..... 224/45 AA; 224/45 W; 224/46 R

[51] Int. Cl.[2] ..... B65D 87/00

[58] Field of Search..... 215/100 A; 224/45 R, 45 A, 224/45 AA, 45 AB, 46 R, 45 W, 45 BA, 45 L, 45 H, 45 C, 49, 48 W

[56] References Cited

UNITED STATES PATENTS

| | | | |
|---|---|---|---|
| 1,326,003 | 12/1919 | Spohr | 224/45 W X |
| 1,965,726 | 7/1934 | Smith, Jr. | 224/46 R |
| 2,248,234 | 7/1941 | Hicuman et al. | 224/45 BA X |

*Primary Examiner*—Frank E. Werner
*Attorney, Agent, or Firm*—Stuart R. Peterson

[57] ABSTRACT

The device includes a pair of U-shaped rods, which function as jaws for gripping the neck of a water cooler bottle when lifting the bottle from its carton or case, the jaws being pivotally connected to transverse rods which are part of a generally rectangular frame. A pair of hoops, likewise in rod form, are pivotally connected to the ends of longitudinal rods which are also an integral part of the rectangular frame, the hoops having handles which facilitate the lifting. After the bottle has been removed from its carton and while resting on the ground or floor, the hoops are placed in ana encircling relation with the body of the bottle so that the bottle can be readily tilted into a horizontal position. Thereafter, when the bottle is to be inverted for placing into the water cooler, the hoop handles are grasped with one hand and the above-mentioned jaws with the other hand so that the bottle can be quickly turned upside down and lowered into the water cooler.

10 Claims, 10 Drawing Figures

Fig 3
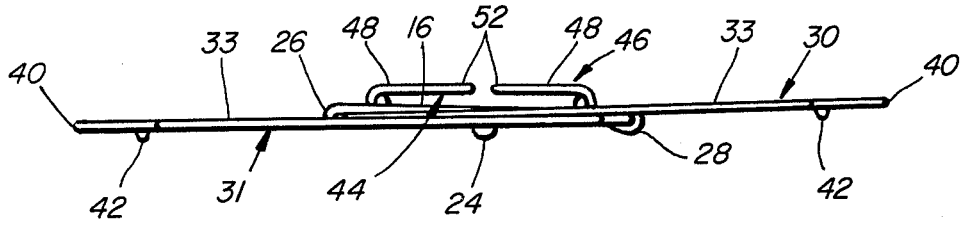
Fig 8
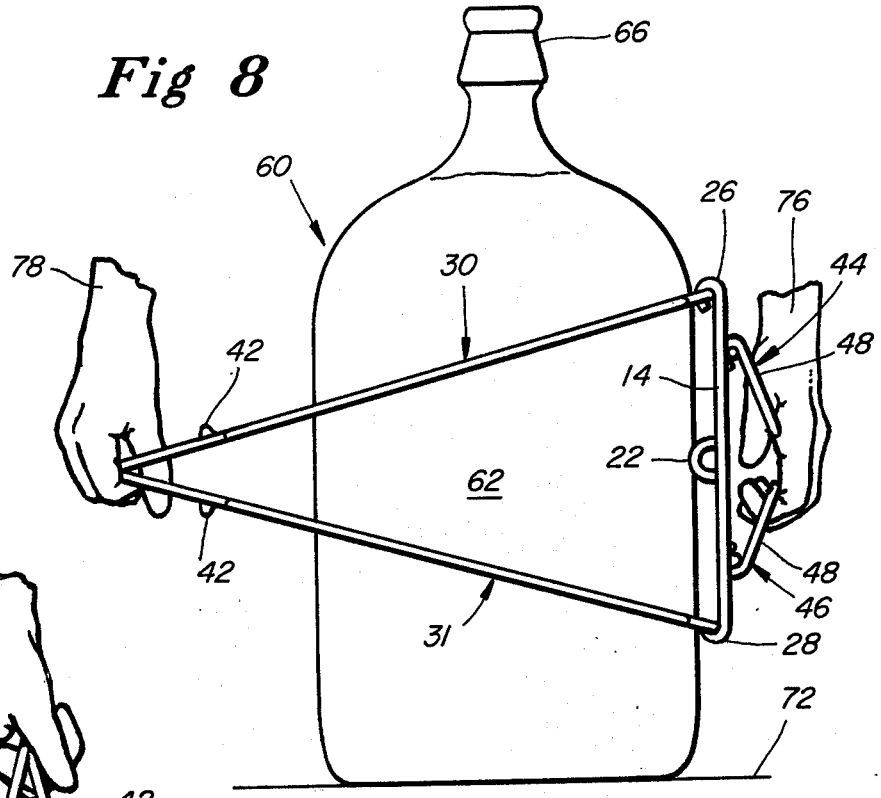
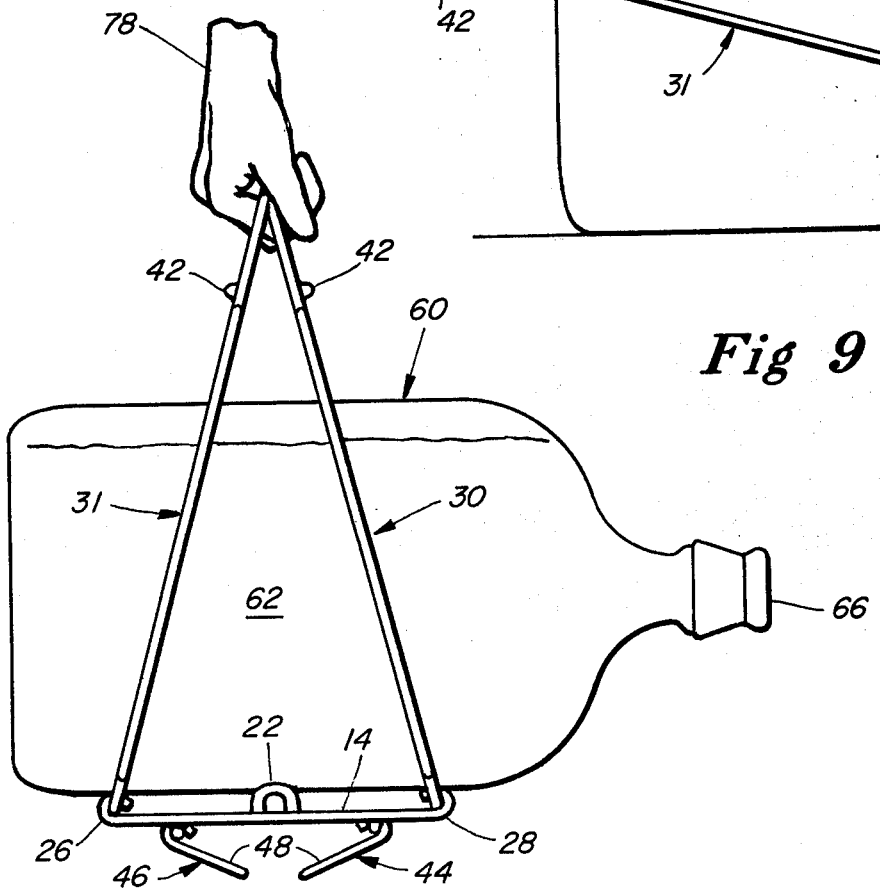
Fig 9

DEVICE FOR LIFTING, CARRYING AND INVERTING WATER COOLER BOTTLES

BACKGROUND OF THE INVENTION

1. Field of the Invention

This invention relates to a device for lifting, carrying and/or inverting relatively large bottles, such as the 5 gallon size used in conjunction with water coolers.

2. Description of the Prior Art

The facile handling of water cooler bottles, which when full weigh approximately 60 pounds, poses a problem that has been long recognized, but for which a satisfactory solution has not yet, to my knowledge, been devised. Normally, bottled water is delivered by truck to the office or home, each bottle being contained in a heavy cardboard carton or case. While the carton is provided with hand slots at each side, such slots only enable the driver to lift the bottle from the truck and provide no real help in carrying the bottle into the office or home. Owing to the carrying difficulty, a two-wheeled truck is usually employed. Where steps and congested conditions are encountered, even the two-wheeled truck is not completely satisfactory. Even after the bottle of water is delivered to its destination, a serious hurdle still remains in that the bottle must be removed from its carton, inverted and placed in the dispensing cooler. The size and weight (60 pounds as already mentioned) of a full bottle makes this task quite difficult, so the need for a device that will simplify the procedure becomes readily apparent.

SUMMARY OF THE INVENTION

Accordingly, a general object of my invention is to facilitate the picking up, the carrying and the inverting of relatively large bottles, such as the 5 gallon size used in conjunction with water coolers, thereby making the delivery and the placing of the bottled water in the cooler much easier than heretofore. Thus, it is within the purview of the invention to reduce human fatigue and alleviate the back-breaking conditions that have heretofore prevailed in the manual handling of such heavy bottles.

Another object of the invention is to provide a device of the foregoing character that can be inexpensively made from wire or rod stock that will result in a bottle carrier that will be rugged yet light in weight.

Another object is to provide a bottle carrier that can be readily collapsed so that it occupies but little space when not in use.

Yet another object of the invention is to eliminate the need for using a two-wheeled truck or cart, thereby enabling the bottled water to be delivered without resort to equipment of this type, particularly where stairs and other obstacles hinder the efficient utilization of any such wheeled means.

A further object of the invention is to provide a bottle carrier that can be manipulated quickly into various usable positions. In this regard, it is contemplated that the carrier can be easily applied to the neck of the water bottle for lifting purposes, then detached from the neck and placed over the bottle for carrying purposes, and finally inverted without additional manipulation when placing it in the water cooler.

Still another object is to minimize the chance of dropping a bottle of water, my device reliably holding the bottle throughout the various angular positions through which it is moved between the delivery truck and cooler, thereby virtually eliminating the chance of bottle breakage.

Briefly, my invention envisages a collapsible or foldable bottle carrier composed of wire or rod stock covered with a plastic coating, such as polyvinyl chloride. A frame composed of two longitudinal rods and a pair of transverse rods support a pair of pivotal jaws, also of rod stock, which are configured so as to grip the neck of the bottle when the bottle is being lifted from its carton or case. A pair of wire or rod hoops are pivotally attached to opposite ends of the frame and have handles thereon which are grasped during the picking up or lifting procedure. After the bottle has been removed from its carton, it can be placed, still in an upright position, on the floor or ground. The hoops can then be swung from their initial position into an oppositely directed relationship. When placed in an encircling relation with the body of the water bottle, the bottle can be tilted and carried horizontally from the delivery truck to the water cooler. Upon reaching the cooler, the neckgripping jaws are at this time grasped with one hand, while the handles on the hoops are held with the other hand, so that the bottle of water can be elevated, tilted into an inverted position and easily lowered into the water cooler. After the bottle has been placed in the water cooler, my device is readily raised and removed from the bottle, then being available for handling another full bottle in the same fashion as outlined above.

BRIEF DESCRIPTION OF THE DRAWINGS

FIG. 3 is a front elevational view of the collapsed device, the view being taken in the direction of line 3—3 of FIG. 2;

FIG. 8 is an elevational view of the bottle with my device being applied thereto in preparation for tilting the bottle into a horizontal position for carrying purposes;

FIG. 9 is a view of my device when carrying the bottle after it has been tilted into a horizontal position from the vertical position shown in FIG. 8.

DESCRIPTION OF THE PREFERRED EMBODIMENT

Figure 1:
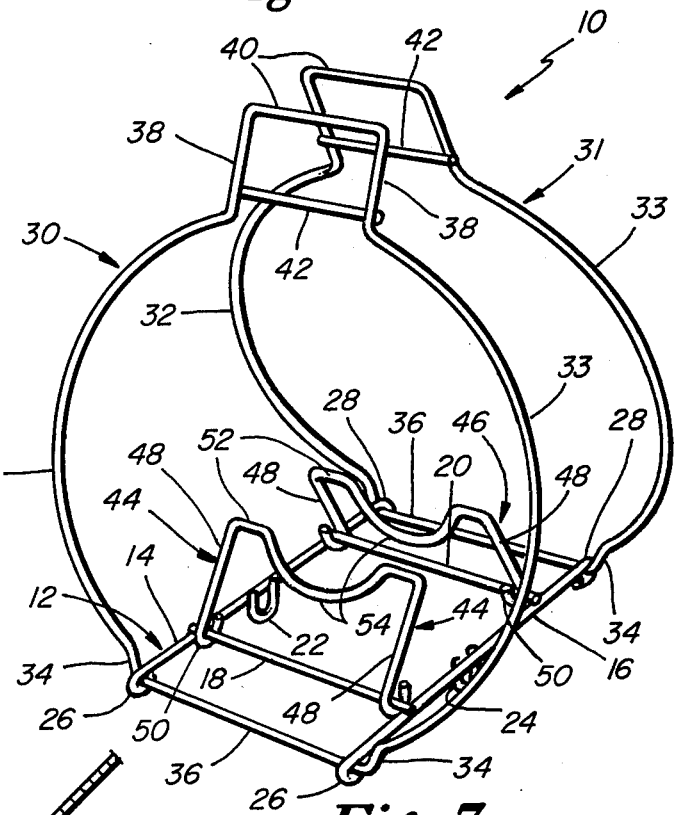
FIG. 1 is a perspective view of my device with the parts thereof in the general relationship they assume for picking up a water bottle by its neck.

My device has been denoted in its entirety by the reference numeral 10. All of the component parts comprising the illustrated device 10 are visible in FIG. 1; therefore, attention is directed at this time to this particular figure.

First, it will be seen that a rectangular frame designated by the reference numeral 12 includes a pair of longitudinal rods 14, 16 and a pair of transverse rods 18, 20, the ends of the transverse rods 18, 20 being welded to the underside of the two longitudinal rods 14, 16 at locations spaced from the ends of these two rods 14, 16. Centrally positioned beneath the rods 14, 16 are U-shaped lugs or ears 22, 24, the purpose of which will be explained hereinafter.

At this time, it will be noted that the opposite ends of the longitudinal rods 14, 16 are reversely turned or bent, these ends being labeled by the reference numerals 26 and 28. The purpose of bending the rod ends 26, 28 is to pivotally mount or hinge a pair of hoops or rings 30 and 31. More specifically, the hoops 30 and 31 are formed with arcuate or curved portions 32, 33 and also outturned portions 34 which integrally connect with a straight segment or offset chordal portion 36. The section 36 of the hoop 30 is pivotally received in the reversely turned ends 26 of the longitudinal rods 14 and 16, whereas the corresponding section 36 of the ring 31 are similarly received in the reversely turned ends 28 of these two longitudinal rods 14, 16. Additional outturned portions 38, which are diametrically opposite the portions 34, are provided and a straight handle section 40 extends between the outturned portions 38. A brack 42 extends between the portions 38 in a spaced relation with the straight handle sections, thereby providing an adequate opening for the reception of a person's hand.

A pair of jaws 44, 46 are provided, the jaws actually being U-shaped and composed of a pair of parallel legs 48 having reversely turned ends 50 which are looped about the previously mentioned transverse rods 18, 20. A connecting bight 52 extends between the legs 48, the bight in each instance having a curved midsection portion 54 that extends toward the transverse rod 18 or 20, as the case may be. As will soon become clear, the curved midsections 54 actually engage the neck of the bottle now to be referred to.

Figure 6:
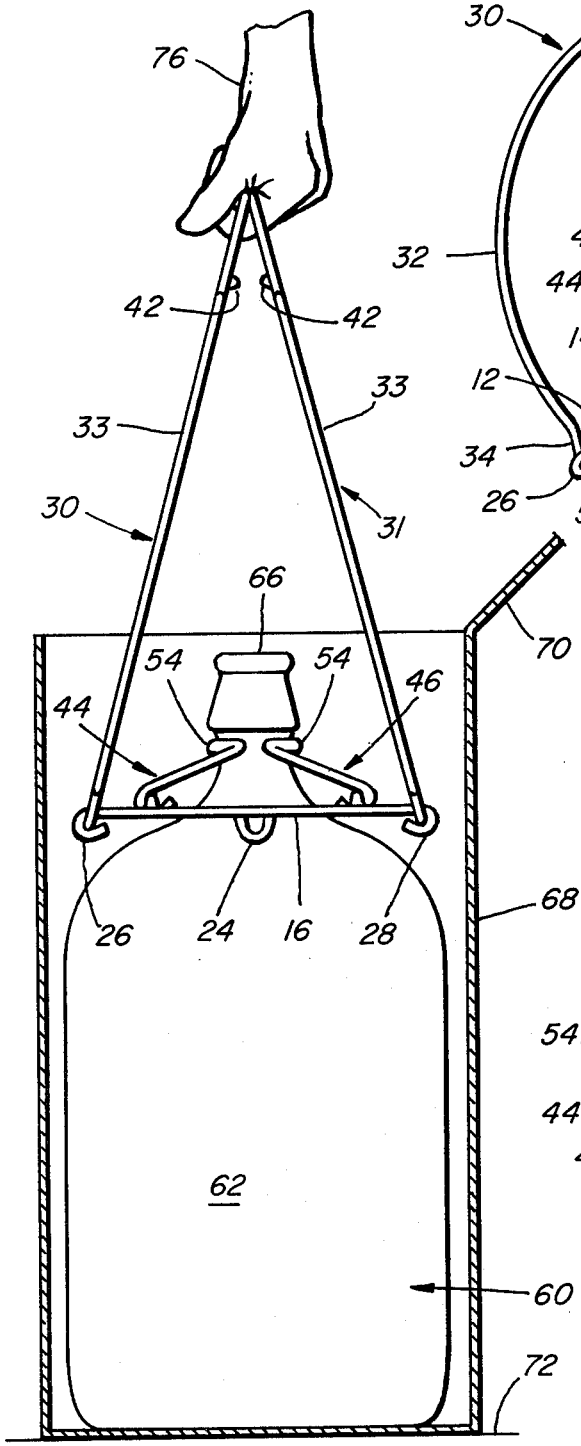
FIG. 6 is an elevational view of my device being used to lift a water bottle from its case or carton.

The bottle, which has been labeled 60, includes a cylindrical body 62 and a neck 64 having a pouring lip **64*a* and a strengthening rib 64*b* spaced therebeneath. A removable rubber cap 66 embraces the pouring lip 64*a* and extends downwardly toward the lower rib 64*b*, the cap serving the dual purpose of preventing leakage and also sanitarily protecting the lip 64*a*. As far as the shipping of the bottle 60 is concerned, this is usually done in a heavy cardboard case or carton 68 having a hinged lid 70 integral therewith. Although not shown in FIG. 6, the carton 68 has slots or hand openings in the sides thereof so that the carton can be handled more readily. As shown in FIG. 6, the carton is resting on the ground or floor 72. The upper end of a typical water cooler 74 has been shown in FIG. 10.**

Figure 7:
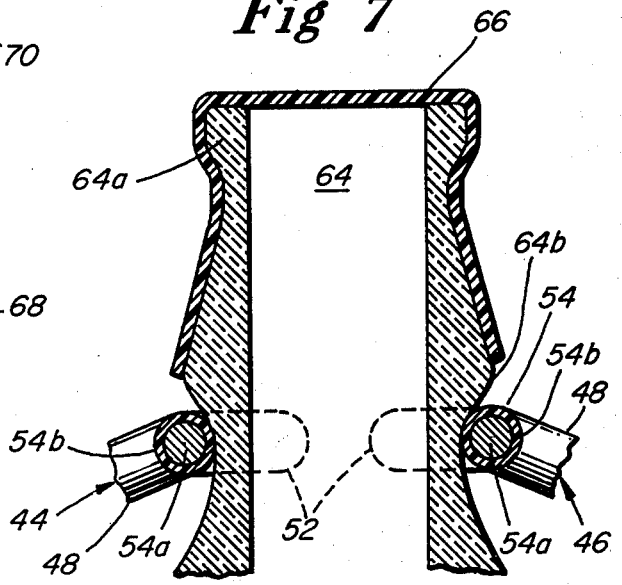
FIG. 7 is a fragmentary sectional view of the bottle neck with the jaws being shown in the same gripping relationship depicted in FIG. 6.
Figure 4:
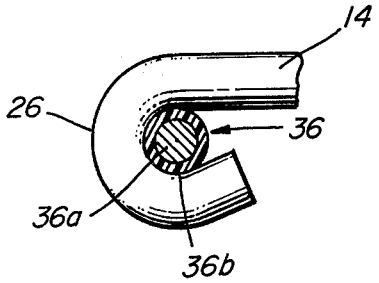
FIG. 4 is a sectional detail view taken in the direction of line 4—4 of FIG. 2.
Figure 5:
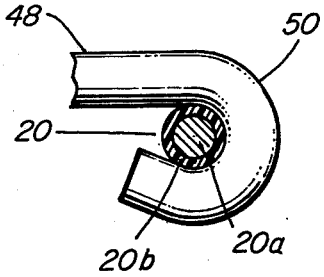
FIG. 5 is a sectional detail view taken in the direction of line 5—5 of FIG. 2.

Up to this stage, nothing has been said concerning the plastic covering that is recommended for the various rods constituting my device 10. This coating should be rather soft and resilient, and polyvinyl chloride has been found to admirably perform the function of preventing slippage irrespective of the position of the bottle 60. One purpose that FIGS. 4 and 5 fulfill is to show the plastic covering. Since the chordal segment 36 has just been referred to generally, being a component or integral part of the generally cylindrical hoop 30, it will suffice, it is thought, to simply indicate the metallic core or rod portion as **36*a* and the plastic covering or coating as 36*b*. Similarly, in FIG. 5, the core or metal rod 20 has been labeled 20*a* and the coating or covering 20*b*. The same approach has been selected as far as FIG. 7 is concerned, for this view shows the curved midsection 54 in cross section, so the core or rod has been labeled 54*a* and the covering or coating 54*b*. Of course, all of the metal is covered with the polyvinyl plastic, but it is not seen necessary to show the covering in any more detail than that that has been accomplished by resorting to FIGS. 4, 5 and 7.**

It can be pointed out that when using steel rod stock having a ¼ inch diameter and the complete covering of the rod parts with plastic, as mentioned above, the total weight of my device is still only a little over two pounds (actually 2¼ pounds), which is indeed light and insignificant in comparison to the weight of a filled bottle (60 pounds).

Having presented the foregoing information, the manner of using my device 10 will now be described. Assuming that the bottle 60, which is filled with spring or distilled water, is contained in the carton 68 as illustrated in FIG. 6, the user of my device 10 will first manipulate the various parts thereof so that they assume approximately the position depicted in FIG. 1. It will be observed that the jaws 44, 46 incline upwardly, being hinged or pivotally attached to the transverse rods 18, 20, respectfully. The upward divergence or angulation of the jaws 44, 46 is sufficient so as to space the bights 52, more specifically the curved midsections 54 thereof, so that the jaws can clear and pass downwardly to a location such that when the device 10 is raised, the inward positioning of the jaws 44, 46 will result in the curved midsections 54 engaging the lower rib **64*b* of the bottle neck 64. This condition is pictured in FIG. 6 but is probably better viewed in FIG. 7.**

With the two hoops 30, 31 angled as illustrated in FIG. 6, this being with the handle sections 40 in a proximal relationship with each other, a person's left hand 78 (although it could equally well be his right hand) is simply inserted between the handle sections 40 and reinforcing braces 42 of the hoops 30, 31 in preparation for lifting the device 10 and the bottle 60. All that the person need do is to lift the device 10 with the jaws 44, 46 engaged in the fashion described above and which manner is shown in FIGS. 6 and 7. The bottle 60, owing to its substantial weight (which is on the order of 60 pounds) forces the jaws 44, 46 downwardly and against the neck 64. Consequently, when the device 10 is raised, the gripping action supplied by the jaws 44, 46 result in the bottle 60 being lifted from the case or carton 68. Hence, there is no need to tilt the carton on its side, or manually grasp the bottle's neck 64 inasmuch as the bottle 60 can be moved directly upwardly when using my device 10.

Although not pictured, the bottle 60 would then be shifted while being suspended from my device 10 to one side and then lowered so that it rests directly on the floor or ground 72. Merely moving the device 10 slightly downwardly, while the bottle is on the floor 72, will release the jaws 44, 46 in that they can be swung outwardly from their obstructive relationship with the lower rib **64*b*. When swung sufficiently outwardly, the cirved midsections 54 of the bights 52 will then clear the rib 64*b* and the device 10 can be elevated so that it is completely separated or detached from the neck 64 of the bottle 60.**

With the device 10 free of the bottle 60, the user then swings the two hoops 30, 31 through an angle of roughly 200° from the position shown in FIG. 6. Close comparison of FIGS. 6 and 8 will reveal that the hoops 30, 31 in FIG. 6 project from the opposite side of the rectangular frame 12 than they do in FIG. 8. It will be helpful to note that the U-shaped lugs or ears 22, 24 are on the side of the frame 12 away from the hoops 30, 31, whereas in FIG. 8, they are on the same side of the frame 12 as are the lugs or ears 22, 24.

Having swung the hoops 30, 31 into the relation just described, then the person grasps the jaws 44, 46, more specifically their bights 52, with his left hand 76 as illustrated in FIG. 8, using his right hand 78 to engage or grasp the straight handle sections 40. Of course, the use of one's left and right hands can be reversed; it is just that the designated hand relationship lends itself readily to the picturing resorted to in FIG. 8. At any rate, the device 10 is then lowered over the cylindrical body 62 so that it is approximately midway between the bottom and the neck of the bottle. The right hand 78 is then employed for literally squeezing the handle sections 40 into a relatively close or proximal relationship with each other which causes the hoops 30, 31 to bear against the body 62. It is at this time that the two lugs 22, 24 bear or seat themselves against the body 62 and help in preventing any slippage.

With the bottle 60 embraced as shown in FIG. 8, the person can then lift the bottle by means of the handle sections 40 and the bights 52. If the bottle 60 is to be carried, then the user retains his grip on the handle sections 40 with his right hand 78 as illustrated in FIG. 9. The bottle 60 is then cradled against the rectangular frame 12 and can be readily carried to the water cooler 74.

Figure 10:
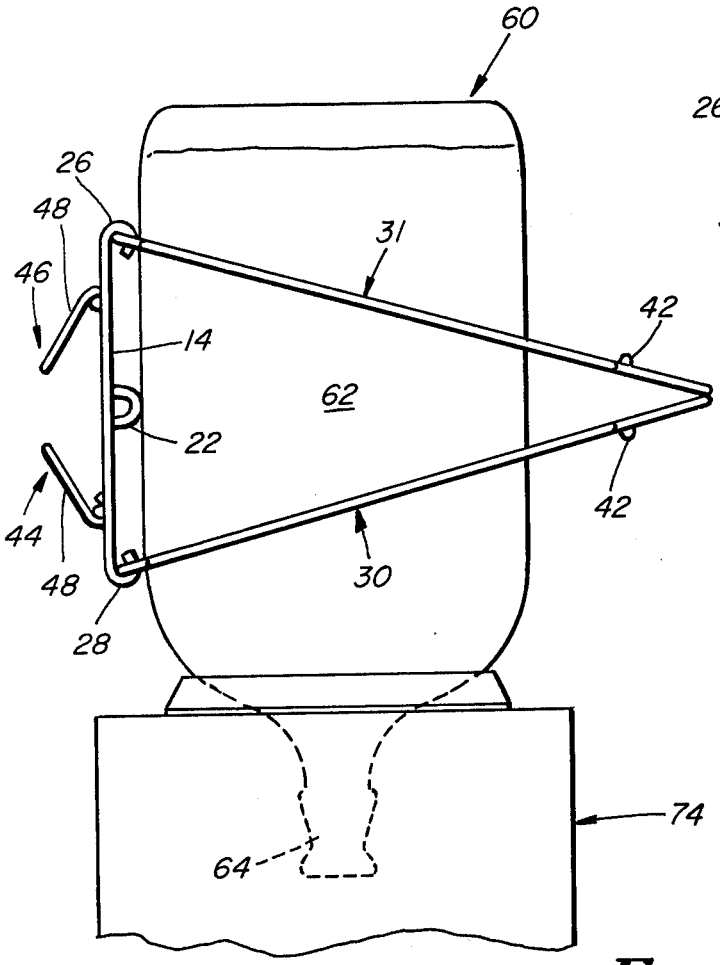
FIG. 10 is an elevational view of the bottle after it has been inverted and lowered into a water cooler by means of my device.

Upon reaching the water cooler 74, then the left hand 76 is used in the same manner it appears in in FIG. 8, the right hand 78 remaining in a gripping relation with the handle sections 40, so that the bottle 60 can be tilted or inverted as shown in FIG. 10. The cap 66 will first have been removed prior to reaching the inverted position portrayed in FIG. 10. However, the transitional movement is difficult to picture without going to several additional views. Usually, the delivery man will tear off the cap 66 and will quickly invert the bottle 60 so that very little, if any, water escapes (other than into the cooler 74) during the inversion procedure. The same practice is followed when utilizing the teachings of the present invention, the use of the device 10 actually speeding up the inversion process and at the same time making it much easier for the delivery man. It should be appreciated that the inverted relationship shown in FIG. 10 can be more readily achieved when using my device 10 and that the inverted bottle 60 can also be lowered readily into the water cooler 74 while still being gripped by my device 10.

With the bottle 60 now resting on the cooler 74, the device 10 can be quickly removed by simply moving the handle sections 40 away from each other which releases the gripping action that the hoops 30, 31 have been performing. The device after it has been raised sufficiently upwardly and is completely free of the bottle 60 (a relationship not thought necessary to depict) is then available for use in handling another bottle.

Figure 2:
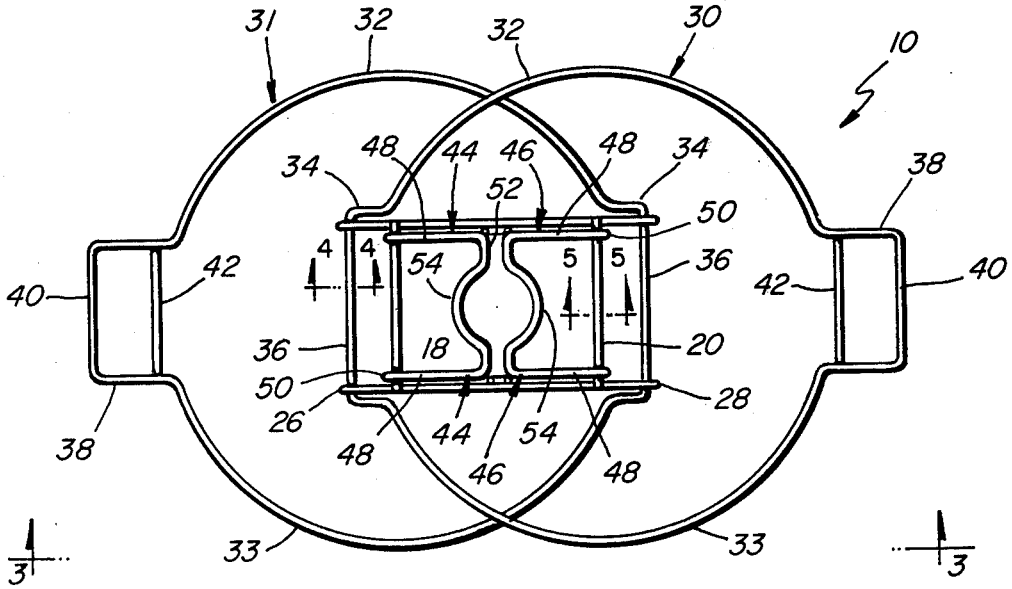
FIG. 2 is a top plan view of the device in a collapsed condition.

FIGS. 2 and 3 have been presented in order to emphasize the complete collapsibility of the device 10. The hoop or ring 30 of FIG. 1 has been swung downwardly into a generally planar relation with the frame 12, whereas the hoop or ring 31 has been swung downwardly away from the reader in FIG. 1 and has been further swung into a generally planar relationship with the underside of the rectangular frame 12. When so collapsed, the device 10 takes up very little space and can conveniently be carried by the delivery man after he has completed the delivery of a bottle and can also be stowed readily on the truck until it is needed for the next bottle delivery. The conserving of space can be important in some instances and the compactness of my device 10 is one attribute that should not be overlooked.

I claim:

1. A device for lifting, carrying and inverting water cooler bottles comprising a generally open rectangular frame means, a pair of jaw members each pivotally connected at one end to spaced portions of said frame means and each jaw member having means at its other end for gripping the neck of a water cooler bottle when said jaw members are pivoted into an angular relationship to one side of said frame means with their said other ends nearer each other than the distance between their said one ends so that the neck gripping means of said jaw members can engage the neck of said water cooler bottle when said neck is extending upwardly through said frame means in order to lift said bottle, and a pair of hoop members pivotally connected to portions of the frame means spaced at least as far apart as said one ends of said jaw members so that said hoop members can be pivoted in a direction to said one side of said frame means for lifting said bottle when said neck gripping means of said jaw members are engaging said bottle neck, said frame means having a width less than the body of the bottle and said hoop members being of a size so as to encircle the body of the bottle in order to carry and invert said bottle when said body of the bottle is against said frame means and said hoops encircle said body.

2. The device of claim 1 in which said frame means includes a pair of longitudinal rods having reversely turned ends constituting said second-mentioned spaced portions and a pair of transverse rods inset from said reversely turned ends constituting said first-mentioned spaced portions, said hoop members constituting generally circular rods having segmental portions thereof pivotally received in said reversely turned ends to pivotally connect said hoop members to said frame means, and said jaw members constituting generally U-shaped rods having reversely turned ends for pivotally receiving therein said transverse rods to pivotally connect said jaw members to said frame means.

3. The device of claim 2 in which each of said U-shaped rods has a pair of laterally spaced legs and an interconnecting bight, the bights of both U-shaped rods having central or midsections constituting said neck gripping means curving toward said transverse rods for engaging opposite sides of the neck of said bottle.

4. The device of claim 3 in which the segmental portions of said generally circular rods each have a pair of outturned sections and interconnecting straight chordal sections, the reversely turned ends of said longitudinal rods receiving said chordal sections therein.

5. The device of claim 4 in which said generally circular rods each have additional outturned sections and interconnecting straight chordal sections providing a pair of handles for carrying said bottle.

6. The device of claim 5 including a lug integral with the center of each longitudinal rod for bearing against spaced body portions of the bottle when said bottle is carried.

7. The device of claim 6 in which said lugs constitute relatively small U-shaped rods.

8. The device of claim 5 in which all of said rods are covered with a resilient coating.

9. The device of claim 8 in which said coating is a plastic material.

10. The device of claim 9 in which said plastic material is polyvinyl chloride.

* * * * *